United States Patent [19]

Harroun

[11] Patent Number: 5,058,912

[45] Date of Patent: Oct. 22, 1991

[54] COMBINATION CHAIR/WALKER

[76] Inventor: Mary M. Harroun, 2460 Dundee Rd., Northbrook, Ill. 60062

[21] Appl. No.: 568,847

[22] Filed: Aug. 17, 1990

[51] Int. Cl.[5] ..... A61H 3/04

[52] U.S. Cl. ..... 280/87.021; 135/67; 272/70.3; 297/5

[58] Field of Search ..... 297/5, 6, 441, DIG. 4, 297/444; 135/65, 85, 67; 272/70, 70.3; 280/304.1, 202, 47.4, 47.34, 87.021, 87.041, 87.051

[56] References Cited

U.S. PATENT DOCUMENTS

| | | | |
|---|---|---|---|
| 3,695,702 | 10/1972 | Ingellis | 297/441 |
| 4,342,465 | 8/1982 | Stillings | 135/67 |
| 4,621,804 | 11/1986 | Mueller | 297/6 |
| 4,759,562 | 7/1988 | Vinyard et al. | 280/304.1 |
| 4,770,410 | 9/1988 | Brown | 135/67 |
| 4,953,851 | 9/1990 | Sherlock et al. | 272/703 |

*Primary Examiner*—Kenneth R. Rice
*Assistant Examiner*—Victor E. Johnson

[57] ABSTRACT

A combination chair/walker for aiding elderly and disabled in independent movement over a floor comprises an upstanding frame including a front rail, opposite sides and a back supporting a seat at an intermediate level for a person seated within the frame. An open space is provided forwardly of the seat for the legs of an occupant in both a standing/walking position and a seated position. The open space is defined between said front rail and said seat and a flexible crotch strap extends into the open space between the seat and front rail for preventing an occupant from sliding out of the seat onto the floor. Rollers are provided for movement of the frame over a floor and brakes are provided on at least some of the rollers to immobilize the chair/walker when desired. The front rail is movable between a closed and an open position for permitting a person easy ingress and egress to and from the chair/walker.

16 Claims, 2 Drawing Sheets

COMBINATION CHAIR/WALKER

BACKGROUND OF THE INVENTION

1. Field of the Invention

The present invention relates to a new and improved combination chair/walker for providing elderly and disabled persons with a safe supportive system for both walking and sitting. The combination chair/walker permits an elderly or disabled person to move about independently without significant restraint and provides the safety of a surrounding and enclosing system to prevent falling and sliding o slipping out of the seat.

2. Description of the Prior Art

Wheelchairs have been used by elderly and disabled persons both for sitting and for moving about. Often times wheelchairs require another person to move the occupant about and wheelchairs do not generally permit an occupant to walk in an erect position. Moreover, many wheelchairs do not afford ample safety systems to prevent an occupant from sliding or slipping out of the seat onto the floor or to prevent an occupant from falling forwardly out of the chair.

Walkers are available which require an occupant to lift or slide the unit along the floor and the back side or rear of the walkers are usually open which will sometimes permit the walker to be moved ahead of the occupant at too fast a pace or permit an occupant to fall out of the walker in a rearward direction. Walkers are sometimes difficult for a patient to get into or out of and generally offer no seat or sitting board so that a user can conveniently rest.

OBJECTS OF THE INVENTION

It is an object of the present invention to provide a new and improved combination chair/walker and more particularly a combination chair/walker for use by elderly and disabled persons which provides a safe system for both walking and sitting with minimal restraints.

Yet another object of the present invention is to provide a new and improved combination chair/walker which affords relatively easy ingress and egress and which provides a surrounding or enclosing safety frame system for minimizing the chances of a user falling or sliding/slipping off the seat to the floor.

Still another object of the present invention is to provide a new and improved combination chair/walker of the character described having pivotal frontal cross-bar that is movable between a closed and locked safe position and an open position affording ingress and egress to a user.

Yet another object of the present invention is to provide a new and improved combination chair/walker having a flexiable crotch strap interconnectable between a seat and a frontal cross-bar that offers little obstruction to a user during walking in an erect position yet affords safety to a user seated in the chair/walker for preventing the user from sliding or slipping off the seat onto the floor.

Still another of object of the present invention is to provide a new and improved combination chair/walker having a brake system that is easily operated for securing the chair/walker against unwanted movement.

A still further object of the present invention is to provide a new and improved combination chair/walker that is easy to use, that affords a user ready mobility when desired, that provides comfortable seating for a user and that affords a user the opportunity to walk about in an erect position with a surrounding safety frame to prevent falling.

Another object of the present invention is to provide a new and improved combination chair/walker of the character described that is neat in appearance, easy to clean and maintain and relatively economical to manufacture and repair.

BRIEF SUMMARY OF THE INVENTION

The foregoing and other objects and advantages of the present invention are accomplished in a preferred embodiment disclosed herein comprising a new and improved combination chair/walker for aiding the mobility of disabled and elderly persons including a pair of front legs and a pair of rear legs supporting a seat at a convenient sitting level. Rollers or casters are provided for the legs for supporting the chair/walker for movement over a floor surface and at least one pair of casters is provided with brakes for activation by a user to retain the chair/walker in a stationary position when desired.

The seat extends forwardly of the rear legs and has a forward edge spaced rearwardly of the front legs providing a relatively large open space at the front half of the chair/walker for the user's legs while walking in an erect position or while sitting in the seat.

The combination chair/walker includes a surrounding or enclosing safety framework for supporting an occupant in an erect walking position or while seated and the frame system includes arm supports along opposite sides extending between front and rear legs, a seat back extending upwardly of the seat at the rear edge and a pivotally mounted frontal cross-bar movable between a closed and locked position extending between the front legs and an open position pivotally extended outwardly from one of said front legs for affording a person easy ingress and egress to and from the interior of the safety frame. When the frontal cross-bar is closed and locked, support is provided for the occupant's hands and arms and the cross-bar is used to propel the combination chair/walker in a forward or rearward direction when the occupant is standing in the open area ahead of the seat during use as a walker.

An added safety feature comprises a crotch strap of flexible material extending forwardly of the seat between a user's legs and the detachably secured to the front cross-bar to prevent a user from sliding or slipping off the seat onto the floor or falling down onto the floor from an erect standing position.

BRIEF DESCRIPTION OF THE DRAWINGS

For a better understanding of the present invention reference should be had to the following detailed description taken in conjunction with the drawing, in which.

DETAILED DESCRIPTION OF A PREFERRED EMBODIMENT OF THE INVENTION

Figure 1:
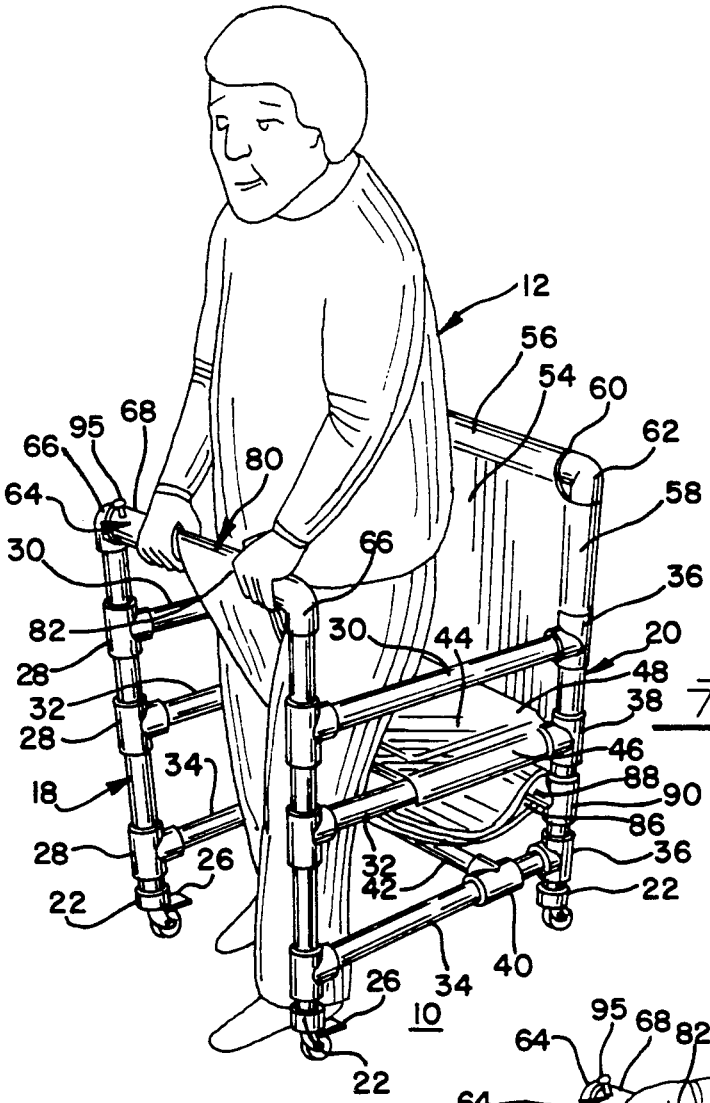
FIG. 1 is a perspective elevational view of a new and improved combination chair/walker in accordance with the present invention shown as in use as a walker with occupant in an erect walking position.

Referring now more particularily to the drawings, therein is illustrated a new and improved combination chair/walker constructed in accordance with the features of the present invention and referred to generally by the reference numeral 10. The chair/walker 10 is especially designed and useful in affording an elderly or disabled person 12 independent mobility when used as a walker (FIG. 1) with the occupant in an upright standing position for walking or as a chair while the occupant is in a sitting position (FIG. 2).

Figure 2:
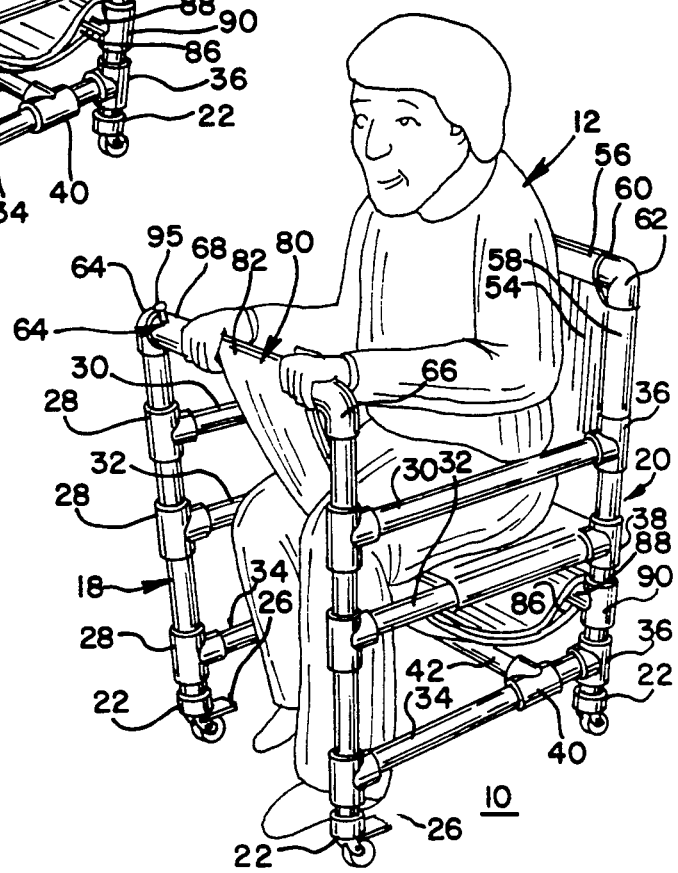
FIG. 2 is a perspective elevational view of the combination chair/walker shown in use with the occupant in a sitting position.

When an occupant 12 is seated in the chair/walker 10 as shown in FIG. 2, the chair/walker may be moved about over a supporting floor surface 14 by use of the feet and legs or the chair/walker may be maintained in a stationary or fixed position when desired by means of a braking system as described hereinafter.

The chair/walker 10 includes a pair of spaced apart upstanding front legs 18 and a pair of spaced apart upstanding rear legs 20 rearwardly thereof. Each leg is provided with a base or cap 22 at the lower end a caster assembly 24 is secured to the cap for supporting the chair/walker for easy rolling movement over the floor surface 14 when desired.

In accordance with the invention, at least one pair of caster assemblies 24 (preferrably the forward caster assemblies) have foot operated brakes thereon provided with toe or foot operated brake levers 26 for locking the caster wheels or rollers against rotation when a user 12 desires to retain the chair/walker 10 in a particular location against movement.

The brake levers 26 are depressed downwardly to lock the rollers of the front caster assemblies 24 against rotation and the brakes are releasable by upward movement of the brake levers 26. At least one pair of the caster assemblies 24 (preferably the front ones) are swivel type casters to provide for steerablity of the combination chair/walker 10.

In accordance with the invention, the front legs 18 are structurally interconnected with the rear legs 20, by means of plurality tees 28 mounted on the front legs and a plurality of elongated, parallel upper, mid level, and lower level side rails 30, 32 and 34, respectively. Rearward ends of the side rails 30, 32 and 34 are interconnected to the rear legs 20 by means of upper and lower tees 36 and an intermediate level 2-way tee fitting 38, mounted on the respective rear legs 20.

The lower side rails 34 are transversely interconnected together for strengthening the structures of the chair/walker 10 by means of a pair of lower tees 40 mounted on rearward portions of the lower siderails and interconnected by a transverse cross-member 42.

Figure 4:
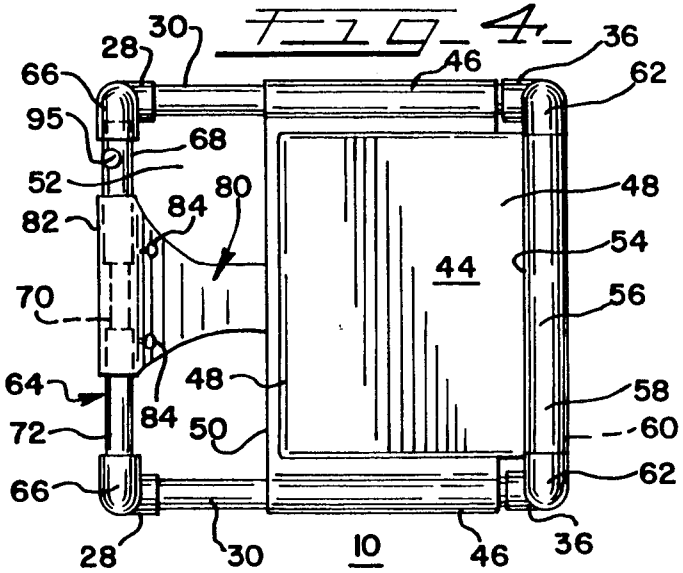
FIG. 4 is a top plan view of the combination chair/-walker.

The intermediate level side rails 32 provide support for a seat 44 formed of strong, light weight, plastic webbing. The seat material is formed with pockets or sleeves 46 at opposite side edges and the rails 32 extend through these pockets as illustrated. A seat cushion or pad 48 may also be provided on the seat 44 to stiffen the seat structure as desired. The seat 44 has a forward edge 50 (FIG. 4) spaced intermediate the front and rear legs 18 and 20 to provide an open space 52 between the forward legs and the seat to accomodate the legs of the user or occupant 12 both in the erect standing/walking position (FIG. 1) and in the seated position (FIG. 2).

The frame work of the chair/walker 10 does not have any transverse cross-members between the tees 28 on the front legs 18 and this area is open and in communication with the open space 54 forward of the seat 44 to afford easy walking for the user 12 without obstruction to forward stepping movements of the legs and feet as shown in FIG. 1.

In order to provide support of the back of an occupant 12 either in the standing/walking position (FIG. 1) or the seated position (FIG. 2), the seat structure includes a back 54 formed of flexible plastic webbing or sheet material. The back is provided with a sleeve or pocket 56 along an upper edge and a pair of side sleeves 58 along opposite side edges.

The upper edge sleeve 56 of the back 54 is supported on an elongated, transversely extending upper back rail 60 extending between a pair of elbows 62 mounted on extended upper end portions of the rear legs 20 at a level above the level of the side arms 30. The side edge pockets 58 of the seat back 54 are extended over the upper end portions of the rear legs 20 and a lower edge of the back web is connected with a rearward edge portion of the horizontal seat 44.

In order to provide frontal support for an occupant 12 using the combination chair/walker 10 either in the standing/walking provided an upper frontal cross-bar assembly 64 extending between upper end portions of the front legs 18. The frontal cross-bar assembly 64 is designed to move between a closed and locked position (FIGS. 1–4) extending transversely between the front legs 18 and an open position (dotted lines FIG. 5) pivoted outwardly from one leg to afford a person easy ingress and egress to the interior of the support system of the chair/walker 10.

The frontal cross-bar assembly 64 includes a pair of elbows 66 mounted on upper ends of the respective legs 18. One of the elbows 66L (left hand elbow FIG. 5) is fixedly secured to a leg 18 and is arranged with an open end facing the opposite leg 18 whereas the opposite elbow 66R is mounted for pivotal movement about a vertical center axis of the opposite leg 18 as shown by dotted lines in FIG. 5.

Figure 5:
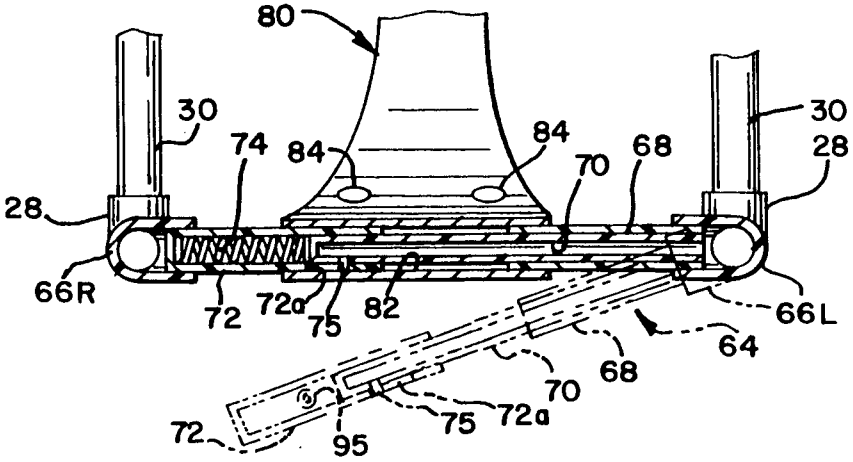
FIG. 5 is a cross-sectional view taken substantially along lines 5—5 of FIG. 3.
Figure 3:
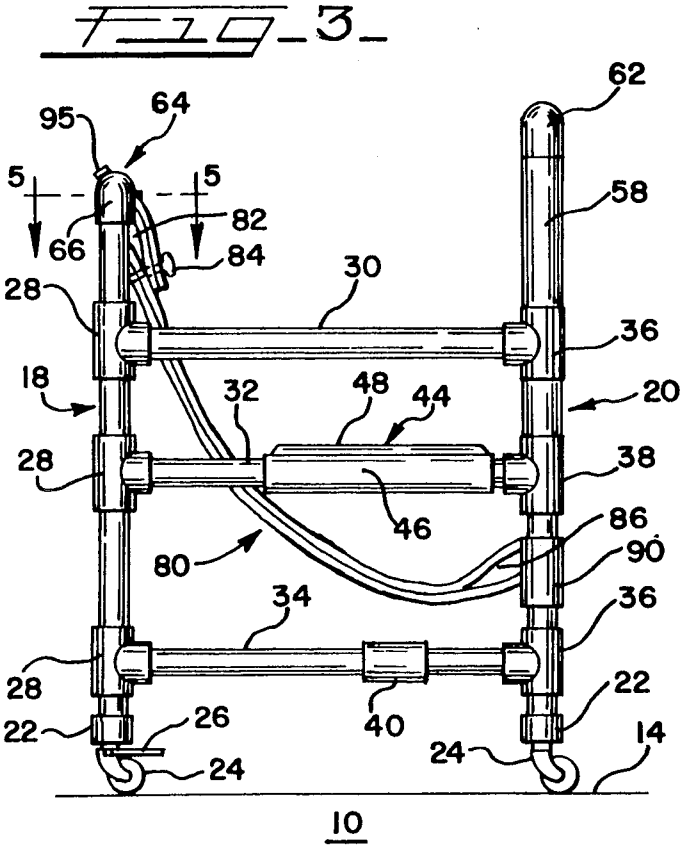
FIG. 3 is a side elevational view of the combination chair/walker.

The elbow 66R supports a right hand sleeve 68 extending outwardly thereof, which sleeve supports an inner tubular element 70 mounted in telescopic relation therewith and including an outwardly projecting end portion which slideably supports a left hand sleeve 72 biased outwardly by an internal spring 74 to engage the elbow 66L when the cross-bar assembly 64 is in the closed and locked position (solid lines FIG.5 ). A radial pin 75 is mounted on the inner element 70 to extend outwardly into a longitudinal slot **72*a* formed in the sleeve 72 and the pin and slot connection limits the relative longitudinal displacement of the sleeve 72 on the inner support tube 70. If desired an external knob 95 is provided on the sleeve 72 for aiding in unlocking and locking the cross-bar assembly 64** before and after movements between alternate positions.

The combination chair/walker 10 includes a flexiable crotch strap 80 formed of strong light weight plastic material and extending forwardly of the front edge 50 of the seat 44 into the open space 52. The crotch strap 80 extends between a user's legs and is detachably connectable to the frontal cross-bar assembly 64. At the forward end, the crotch strap 80 is formed with sleeve or pocket 82 which wraps around the cross-bar and is secured therewith by grommet and tab assemblies 84 which can be removed for detachment of the crotch strap and cross-bar assembly 64.

At a rearward end, the crotch strap 80 is provided with a pocket 86 through which a transversely extending rear cross-bar 88 is extended. The lower rear cross-bar 88 extends transversely between a pair of intermediate level tees 90 which are mounted on the rear legs 20 above the lower level tees 36. The lower rear cross-bar 88 and the upper rear cross-bar or rail 60 add considerable strength to the back side of the chair/walker 10 and additional service to support the crotch strap 80 and seat back 54, respectively.

In view of the foregoing, it will thus be seen that the combination chair/walker 10 in accordance with the present invention, affords an elderly or disabled person 12 independent mobility in an erect standing and walking position (FIG. 1) as well as in a sitting position (FIG. 2). The frontal cross-bar assembly 64 opens to provide easy ingress and egress to the interior of the supporting frame comprising side arm rails 30 and the back 54 as well as access to the seat 44. When closed and locked, the frontal cross-bar assembly 64 offers no impediment to walking as the space below is entirely open to accomodate the legs and feet. In addition, the closed cross-bar assembly 64 offers support for the hands and arms of a user 12 and provides a principle means for guidance of the chair/walker 10 along the floor surface 14. The detachable, flexible crotch strap 80 provides additional support and safety to prevent falling to the floor within the chair/walker 10 either from a standing position within the support framework or from slippage off of the seat 44.

The combination chair/walker 10 is a multi-purpose vehicle and is neat in appearance, relatively low in cost to produce, and easy to maintain and service.

Although the present invention has been depicted and described in terms of a single preferred embodiment, in the appended claims it is intended to include all those equivalent structures, some of which may be apparent upon reading this description and others that may be obvious after study and review.

What is claimed and sought to be secured by Letters Patent of the U.S. is:

1. A combination chair and walker for aiding the independent mobility of elderly, and disabled persons in standing, walking and sitting; comprising:

a plurality of laterally spaced apart front legs and a plurality of rear legs spaced rearwardly thereof for supporting said combination chair and walker for movement over a floor in a stable upright condition;

seat means supported from said legs at a convenient sitting level, said seat means having a forward edge spaced rearwardly of said front legs defining an open space extending rearwardly of said front legs for accommodating a person's legs while in a standing, walking and sitting position in said combination chair and walker;

back support means extending upwardly of a rearward portion of said seat means for supporting a rear side of said person;

side arms means extending forwardly of said back support means at a level above said seat means for supporting said person's sides and arms;

frontal cross-bar means at an upper level above said side arm means extending laterally between upper ends of said front legs while in a closed position parallel of said back support means for supporting said person's front side and arms for guiding said combination chair and walker, said cross-bar means having one end portion pivotally connected to an upper end portion of one of said front legs for pivotal movement toward an open position extended outwardly when an opposite end portion of said cross-bar means is disconnected from an upper end portion of an opposite one of said front legs to permit ingress and egress of said person from a front side of said combination chair and walker;

flexible crotch strap means extending forwardly of said seat means between said person's legs into said open space and securable to said frontal cross-bar means while in said closed position; and longitudinally sliding lock means hand operable at a level above said seat means for lockably securing said frontal cross-bar means against unwanted pivotal and vertical movement while in said closed position for providing a firm hand rail for guiding said combination chair and walker when secured to extend between said upper end portions of said laterally spaced apart front legs.

2. The combination chair and walker of claim 1, wherein:

said lock means includes a manually slidable member for lockingly engaging said frontal cross-bar means and said opposite one of said front legs while said frontal cross-bar means is in said closed position.

3. The combination chair and walker of claim 2, wherein:

said lock means comprises a sleeve slidably mounted on one of said cross-bar means and said opposite front leg slidable longitudinally thereof for locking engagement and disengagement therebetween.

4. The combination chair and walker of claim 1, wherein:

said flexible crotch strap means includes means for detachably interconnecting a front end portion thereof to said frontal cross-bar means.

5. The combination chair and walker of claim 1, wherein:

said flexible crotch strap includes a rear end portion attached adjacent said rear legs below said seat means.

6. The combination chair and walker of claim 1, wherein:

said front and rear legs each include a roller for supporting said combination chair and walker to roll over said floor.

7. A combination chair and walker for use by elderly and disabled persons for movement over a floor surface while walking erect and while standing and sitting, comprising:

frame means defining a structure for supportively surrounding all sides of a person while in a standing, walking and sitting position within said structure;

roller means for supporting said structure for rolling movement over said floor surface;

seat means occupying only a rearward portion of an enclosed space defined within said structure and leaving an open leg space forward of said seat means;

said frame means including a front rail, a plurality of side rails and back support means at levels above said seat means for use in supporting said person, said frame means further including a pair of laterally spaced apart front legs extending upwardly of said side rails at forward ends thereof, said front rail comprising an elongated assembly having one end portion pivotally secured to an upper end portion of one of said front legs and movable between an open position extending outwardly of said frame means ready for ingress and egress of a person into and out of said enclosed space, and said front rail having an opposite end portion detachably interconnectable to an upper end portion of an opposite one of said front legs when said front rail is in a closed position extending laterally with respect to said side rails for providing a hand rail for manually guiding said combination chair and walker adjacent a forward end of said enclosed space;

manually operable lock means above the level of said side rails for securing said front rail against unwanted pivotal and unwanted vertical movement when locked in said closed position; and wherein said lock means included a member slidably relative to said front rail when said front rail is in a position extended transversely between said upper ends of said front legs for locking said front rail in said closed position.

8. The combination chair and walker of claim 7, including:

flexible crotch strap means extending forwardly of said seat means into said open leg space and having a forward end detachably interconnected to said front rail when said front rail is in said closed position.

9. The combination chair and walker of claim 8, wherein:

said crotch strap means extends into said open leg space between a forward edge of said seat means and said front rail.

10. The combination chair and walker of claim 7, wherein:

said roller means includes a plurality of laterally spaced apart front and rear rollers supporting said frame means.

11. The combination chair and walker of claim 10, including:

brake means for retarding rotation of at least one of said rollers.

12. The combination chair and walker of claim 7, wherein:

said member is mounted for slidable movement longitudinally of said front rail to extend transversely between said upper ends of said front legs when said front rail is locked in said closed position.

13. The combination and walker of claim 12, wherein:

said front rail defines the only laterally extending element at a front edge of said open leg space of said frame means above said floor surface when said front rail is in said closed position.

14. The combination chair and walker of claim 13, wherein:

a front end of said open leg space is clear of any laterally extending obstructions between said floor surface and said front rail when said front rail is in said closed position.

15. The combination chair and walker of claim 2, including:

means for biasing said member into said lockingly engaging condition.

16. The combination chair and walker of claim 15, including:

means for limiting longitudinal movement of said member by said biasing means when said cross-bar means is in said open position.

* * * * *

UNITED STATES PATENT AND TRADEMARK OFFICE

CERTIFICATE OF CORRECTION

PATENT NO. : 5,058,912

DATED : October 22, 1991

INVENTOR(S) : Mary M. Harroun

It is certified that error appears in the above-identified patent and that said Letters Patent is hereby corrected as shown below:

TITLE PAGE:

Line [76] - delete "2460 Dundee Rd., "

and insert therefor, -- 1357 Northmoor Court--

Signed and Sealed this

Twenty-third Day of February, 1993

*Attest:*

STEPHEN G. KUNIN

*Attesting Officer*

*Acting Commissioner of Patents and Trademarks*